US008900373B2

(12) United States Patent
Molitor et al.

(10) Patent No.: US 8,900,373 B2
(45) Date of Patent: Dec. 2, 2014

(54) METHOD OF CLEANING BOTTLES IN A BOTTLE CLEANING MACHINE, AND AN ARRANGEMENT FOR PERFORMING THE METHOD, AND A BOTTLE CLEANING MACHINE

(75) Inventors: Bernd Molitor, Rehwinkelas (DE); Klaus Jendrichowski, Holzwickede (DE)

(73) Assignee: KHS GmbH, Dortmund (DE)

( * ) Notice: Subject to any disclaimer, the term of this patent is extended or adjusted under 35 U.S.C. 154(b) by 780 days.

(21) Appl. No.: 12/389,937

(22) Filed: Feb. 20, 2009

(65) Prior Publication Data

US 2009/0211606 A1 Aug. 27, 2009

Related U.S. Application Data

(63) Continuation-in-part of application No. PCT/EP2007/007242, filed on Aug. 16, 2007.

(30) Foreign Application Priority Data

Aug. 23, 2006 (DE) ..... 10 2006 039 599

(51) Int. Cl.

| | |
|---|---|
| ***B08B 9/093*** | (2006.01) |
| ***B08B 9/30*** | (2006.01) |
| ***B08B 9/34*** | (2006.01) |
| ***B08B 9/42*** | (2006.01) |
| ***B08B 9/20*** | (2006.01) |

(52) U.S. Cl.

CPC ... *B08B 9/20* (2013.01); *B08B 9/30* (2013.01); *B08B 9/34* (2013.01)

USPC ..... 134/22.18; 134/21; 134/22.1; 134/23; 134/24; 134/25.1; 134/32; 134/36; 134/56 R; 134/94.1; 134/129; 134/137; 134/168 R; 134/169; 134/172; 134/199; 134/142; 134/148

(58) Field of Classification Search

CPC ..... B08B 9/20; B08B 9/28; B08B 9/30; B08B 9/32; B08B 9/34; B08B 9/42

USPC ..... 134/22.1, 22.18, 23, 25.2, 32, 130, 131, 134/133, 142, 148, 169 R, 184, 199, 152

See application file for complete search history.

(56) References Cited

U.S. PATENT DOCUMENTS

| | | | | |
|---|---|---|---|---|
| 899,017 | A | 9/1908 | Arnold et al. | |
| 3,111,131 | A * | 11/1963 | Nekola et al. | 134/129 |

(Continued)

FOREIGN PATENT DOCUMENTS

| | | |
|---|---|---|
| DE | 17 82 042 | 7/1971 |
| DE | 196 50 944 | 6/1998 |

(Continued)

OTHER PUBLICATIONS

International Search Report PCT/EP2007/007242 and English translation thereof.

(Continued)

*Primary Examiner* — Michael Kornakov
*Assistant Examiner* — Natasha Campbell
(74) *Attorney, Agent, or Firm* — Nils H. Ljungman & Associates

(57) ABSTRACT

A method of cleaning containers in a container cleaning machine, in which the containers are moved in receptacles to a cleaning area, where both the containers and the receptacles are at least partially submerged in a dipping bath of liquid cleaning medium. The containers are positioned such that closed portions of the containers are at an equivalent or higher vertical position than mouth portions of the containers. A nozzle arrangement is used to produce a jet of a cleaning medium which impinges the interior of a corresponding container. The jet has a force which is insufficient to move the container from its resting position in its corresponding container receptacle.

20 Claims, 5 Drawing Sheets

(56) References Cited

U.S. PATENT DOCUMENTS

| | | | | |
|---|---|---|---|---|
| 3,677,273 | A * | 7/1972 | Mahlstede et al. | 134/127 |
| 4,080,974 | A * | 3/1978 | Oag | 134/62 |

FOREIGN PATENT DOCUMENTS

| | | | |
|---|---|---|---|
| GB | 168 755 | | 9/1921 |
| GB | 224 658 | | 11/1924 |
| GB | 1 209 323 | | 10/1970 |
| JP | 46010714 | B | 3/1971 |
| JP | 55079296 | A | 6/1980 |
| JP | 59119383 | U | 8/1984 |
| JP | 349759 | U | 5/1991 |
| JP | 8243522 | A | 9/1996 |
| JP | 200533487 | A | 12/2005 |

OTHER PUBLICATIONS

English Translation of International Preliminary Report on Patentability PCT/EP2007/007242.

* cited by examiner

METHOD OF CLEANING BOTTLES IN A BOTTLE CLEANING MACHINE, AND AN ARRANGEMENT FOR PERFORMING THE METHOD, AND A BOTTLE CLEANING MACHINE

CONTINUING APPLICATION DATA

This application is a Continuation-In-Part application of International Patent Application No. PCT/EP2007/007242, filed on Aug. 16, 2007, which claims priority from Federal Republic of Germany Patent Application No. 10 2006 039 599.9, filed on Aug. 23, 2006. International Patent Application No. PCT/EP2007/007242 was pending as of the filing date of this application. The United States was an elected state in International Patent Application No. PCT/EP2007/007242.

BACKGROUND

1. Technical Field

The present application relates to a method of cleaning bottles in a bottle cleaning machine, and an arrangement for performing the method, and a bottle cleaning machine. The present application also relates to a method for the treatment of bottles or similar containers and a cleaning machine and also a cleaning machine.

2. Background Information

Background information is for informational purposes only and does not necessarily admit that subsequently mentioned information and publications are prior art.

Some machines include numerous designs for cleaning machines for cleaning bottles or other containers.

With such machines, the treatment of the containers typically occurs in at least one dipping bath, which is filled with a cleaning liquid (e.g. alkaline liquid or acid) when the cleaning machine is operational.

A circulating transport system moves containers arranged in receptacles of container carriers through the dipping bath so that the containers are completely submerged in the cleaning liquid.

To enhance the efficacy of the cleaning liquid in the dipping bath relative to the treatment of the inside surfaces of the containers, some machines teach the impingement of the inside surfaces of the containers submerged in the cleaning liquid of the dipping bath with a treatment jet of the treatment medium, e.g. with a jet of liquid or air, to improve the exchange of the treatment liquid inside the individual containers with fresh treatment liquid from the dipping bath and to thus enhance the cleaning effect.

The impingement of the containers with the impingement jet is by means of a treatment nozzle arranged above the horizontal path of motion of the upright containers, i.e. the containers are oriented with the opening facing upward.

Some machines further teach that each bottle receptacle on the transport system of a bottle cleaning machine is equipped with a treatment nozzle in the form of an injector tube, which is inserted through the bottle opening and into the bottle arranged in the respective bottle receptacle.

In the dipping bath, the transport system forms a deflector, bend, or diversion at which the transport element of this system having the bottle receptacles is deflected around a horizontal axis perpendicular or substantially perpendicular to the direction of transport.

To also treat the inside of the bottles submerged in the cleaning liquid of the dipping bath with a cleaning liquid, fixtures that circulate synchronously or individually with the bottle receptacles are provided at the deflector, which fixtures connect each of the treatment nozzles present in the bottle receptacles with a separate source for the controlled feed of the treatment medium.

Alone the need or desire to couple and decouple these connections to the treatment nozzles results in a mechanically complex, expensive and fault-prone construction.

OBJECT OR OBJECTS

An object of the present application is to describe a method by which effective impingement of the interior of bottles or similar containers with a treatment jet as they pass through a dipping bath to enhance the efficacy of this dipping bath can be achieved with reduced design complexity.

SUMMARY

The present application relates to a method for the treatment of bottles or similar containers in a cleaning machine. The containers, arranged in receptacles of container carriers, are moved on a transport track of a transport system between a container inlet and a container outlet through multiple treatment zones, of which at least one is a dipping bath. A deflector is located in the transport track inside the dipping bath, at which deflector the path of the transport track causes the containers to turn from an orientation with their container opening facing up to an orientation with their container opening facing down. The interior of each container in the dipping bath is impinged with a treatment jet of a treatment medium from a treatment nozzle arrangement. The present application further relates to a cleaning machine for the cleaning of bottles or similar containers, comprising a transport system, in which the containers arranged in receptacles of container carriers are moved on a transport track of the transport system between a container inlet and a container outlet through multiple treatment zones. At least one treatment zone includes a dipping bath with at least one deflector formed by the transport track inside the dipping bath. At that deflector, the path of the transport track causes the containers to turn from an orientation with their container opening facing up to an orientation with their container opening facing down, and with a treatment nozzle arrangement for the impingement of the interior of each container in the dipping bath with a treatment jet of a treatment medium.

A method for achieving this object is disclosed as a method for the treatment of bottles or similar containers in a cleaning machine, in which the containers, arranged in receptacles of container carriers, are moved on a transport track of a transport system between a container inlet and a container outlet through multiple treatment zones. One treatment zone includes a dipping bath, where at a deflector in the transport track inside the dipping bath, the path of the transport track causes the containers to turn from an orientation with their container opening facing up to an orientation with their container opening facing down. The interior of each container in the dipping bath is impinged with a treatment jet of a treatment medium from a treatment nozzle arrangement. The respective treatment jet is produced by a treatment nozzle arrangement at some distance from the container being treated and the container receptacle and is controlled such that only those containers whose force component of the weight force acting in the direction of the treatment jet offsets the force imparted by the treatment jet at least to the extent that the container being treated is not moved by the treatment jet are impinged by the at least one treatment jet.

A cleaning machine implementing this method is the subject of a cleaning machine for the cleaning of bottles or similar containers, comprising a transport system, with which the containers, arranged in receptacles of container carriers, are moved on a transport track of the transport system between a container inlet and a container outlet through multiple treatment zones. At least one of the treatment zones is a dipping bath, with at least one deflector formed by the transport track inside the dipping bath, at which deflector the path of the transport track causes the containers to turn from an orientation with their container opening facing up to an orientation with their container opening facing down, and with a treatment nozzle arrangement for the impingement of the interior of each container in the dipping bath with a treatment jet of a treatment medium. The treatment nozzle arrangement producing the treatment jets is at some distance from the containers and the container receptacles moving past, and there is a controller for the control of the treatment nozzle arrangement such that only those containers whose force component of the weight force acting in the direction of the treatment jet offsets the force imparted by the treatment jet at least to the extent that the container being treated is not moved by the treatment jet are impinged by the at least one treatment jet.

With the present application, the impingement of the individual container to be treated is by means of a treatment jet using a free jet process, i.e. the treatment nozzle arrangement or treatment nozzle whose treatment jet impinges the interior of the container being treated through the container opening or mouth is located at some distance from this bottle mouth and also at some distance from the container receptacle of the transport system holding the bottle.

Furthermore, impingement of the containers with the treatment jet occurs in a dipping bath while the containers are completely submerged, or at least have their mouth submerged, in the cleaning liquid in said bath.

Furthermore, impingement of the containers occurs in the vicinity of a deflector in the transport track located in the dipping bath in such a way that the respective treatment jet is applied to those containers which by virtue of the path of the transport track at the deflector are oriented with the container opening or mouth facing downward and whose weight force component running in the direction of the treatment jet at least offsets the force of the respective treatment jet acting on these containers sufficiently to prevent, restrict, and/or minimize the treatment jet from shifting or even lifting the respective container in the container receptacle.

The inclination or orientation of the bottles during treatment further promotes the desired exchange of treatment liquid in the interior of each container treated.

In one possible embodiment of the present application, maximum turbulence is produced in the area of the dipping bath so that the exposure time in the dipping bath can be reduced, restricted, or minimized without affecting cleaning performance and the entire cleaning machine can be sized accordingly smaller.

Further embodiments of the present application are disclosed below.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

One possible embodiment of the present application is described in greater detail below illustrated with the accompanying drawings, in which.

DESCRIPTION OF EMBODIMENT OR EMBODIMENTS

Figure 1:
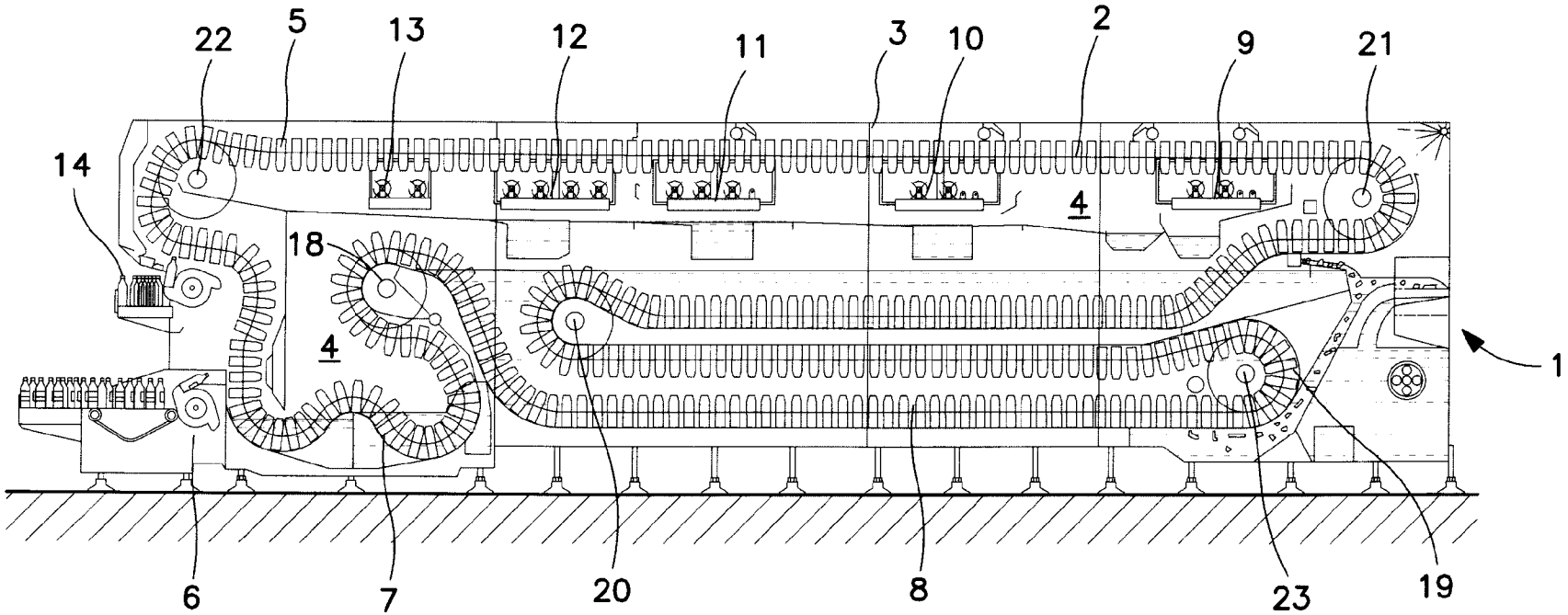
FIG. 1 shows a schematic and a side view of a cleaning machine for the cleaning of containers in the form of bottles.

In the figures, 1 is a cleaning machine for the cleaning of bottles 2.

Located in the interior 4 formed by a housing 3 of the cleaning machine 1 is a transport system 5, with which the bottles 2 to be cleaned are moved through various treatment zones, in one possible embodiment from a bottle inlet 6 through a first dipping bath 7 comprising a cleaning liquid, e.g. alkaline solution, and then through a second dipping bath 8 comprising a cleaning liquid, e.g. acid, and through various spray stations 9, at which the outside and inside surfaces of the bottles are sprayed with spray jets of cleaning liquids and finally with pure water so that the cleaned bottles 2 are then subsequently carried by the transport system 5 to the bottle outlet or bottle discharge 14.

The transport system is comprised of bottle baskets 15 arranged one behind the other and moved by means of circulating transport chains, each of said bottle baskets 15 in this embodiment shown here in highly simplified forms three adjacent bottle cells 16 arranged perpendicular or substantially perpendicular to the direction of transport A.

A bottle 2 is seated centered in each bottle cell 16 so that the mouth 2.1 of said bottle 2 is essentially coincident with an opening 17 in the otherwise closed end of the respective bottle cell 16.

The transport system 5 has multiple deflectors, which are designated in FIG. 1 as 18 through 22, with the deflector 19 located within the dipping bath 8.

As they move past the deflector 19, the bottles are oriented with their bottle axis FA radial or roughly radial to the horizontal axis of this deflector such that the bottle mouths 2.1 and also the openings 17 of the passing bottle cells face this axis.

Provided at the deflector 19 is a treatment nozzle arrangement 23, which is actively rotated in synch with the movement of the bottle baskets 15 around the axis of this deflector.

Figure 2:
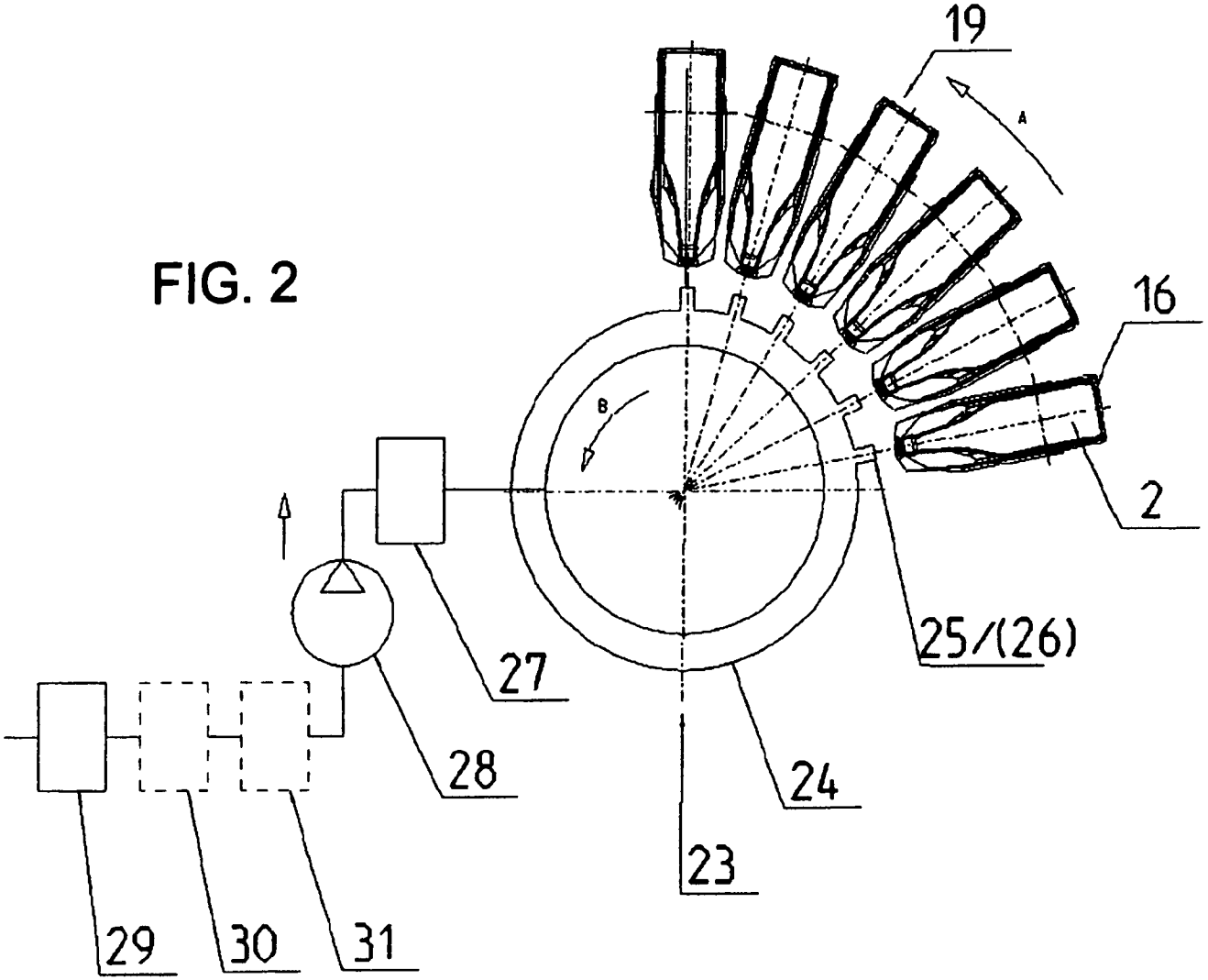
FIG. 2 shows a side view of a single treatment nozzle arrangement according to the present application.
Figure 3:
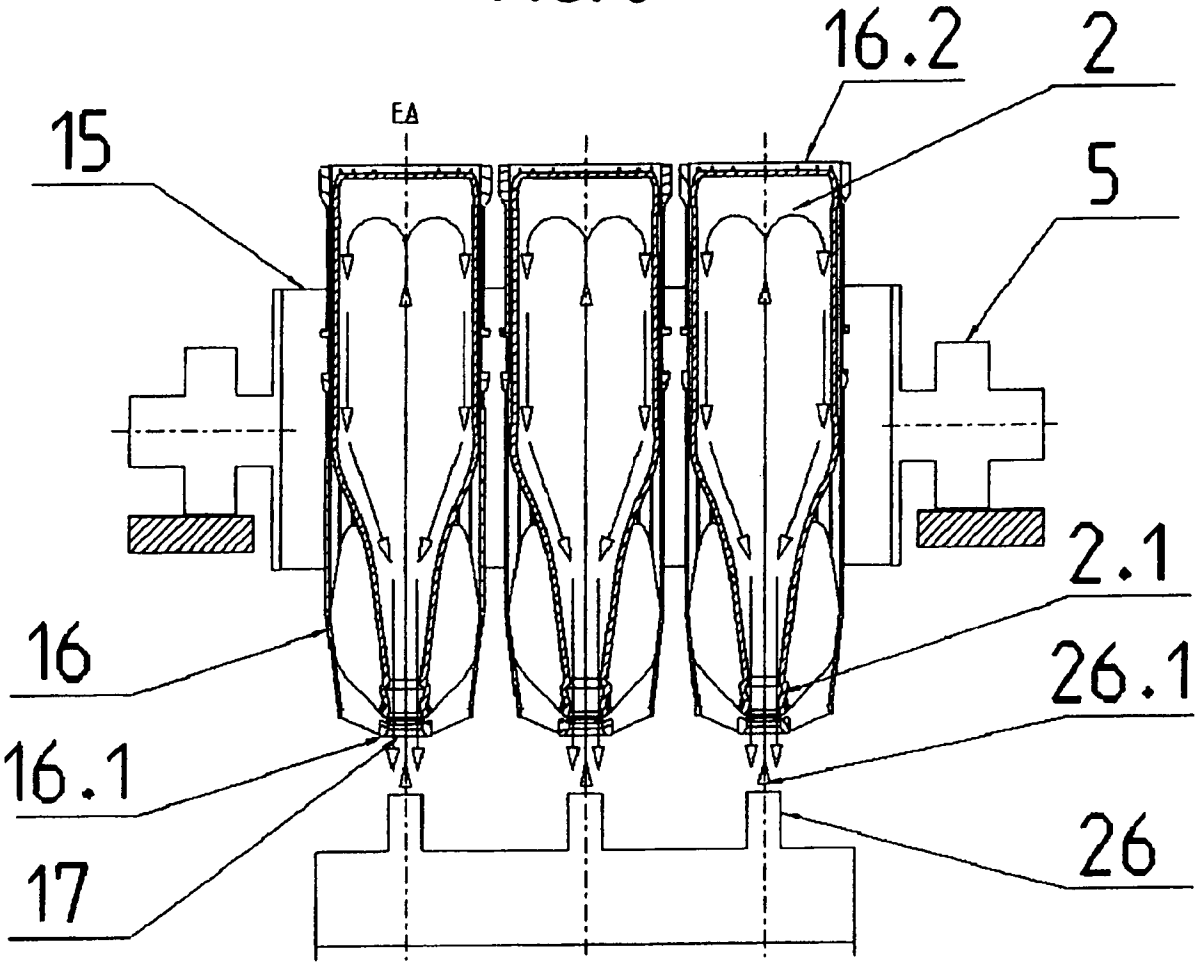
FIG. 3 shows the treatment nozzles in one nozzle row of the treatment nozzle arrangement from FIG. 2.

The treatment nozzle arrangement 23 shown in greater detail in FIGS. 2 and 3 essentially comprises a drum-like carrier 24, on which nozzle rows 25 extending parallel or substantially parallel to the axis of rotation, represented in the figures by arrow B of the treatment nozzle arrangement 23 and having three treatment nozzles 26 corresponding to the number of bottle cells 16 per bottle basket 15 are arranged in equal angular intervals corresponding to the axial distance between two sequential bottle baskets 15 in the direction of transport A.

When the cleaning machine 1 is in operation, the deflector 19 and thus the treatment nozzle arrangements 23 provided inside this deflector are located within the dipping bath 8 below the level of the treatment liquid.

As they approach the deflector 19, the bottles 2 moved with the bottle baskets 15 are oriented so that the bottoms of the bottles 2 face down and the mouths 2.1 of the bottles face up.

In the vicinity of the deflector 19, the bottles 2 are turned as a result of the path of the transport track of the transport system 5 so that they are increasingly oriented with their bottoms up and their mouths down and with the area of their mouths 2.1 resting against the side 16.1 of the bottle cells 16 having the opening 17.

The individual treatment nozzles 26 are connected via a controller 27 to the discharge of a pump 28, whose inlet is connected via a filter 29, such as a fine filter, to the dipping bath 8 for the intake of cleaning liquid from this dipping bath.

The controller 27 controls the nozzle rows 25 such that the treatment nozzles 26 discharge treatment jets 26.1 into those bottles 2 that are located in the vicinity of the deflector 19 and have already been turned such that their mouths 2.1 are inclined sufficiently downward that they rest with a sufficiently large force component of their weight force against the side 16.1 of the respective bottle cell 16.

Furthermore, the pressure of the treatment jets 26.1 exiting the activated treatment nozzles 26 can be set and/or controlled such that the component of the weight force of the respective bottle 2 to be treated acting in the direction of the respective treatment jet 26.1 prevents, restricts, and/or minimizes the bottle 2 from being pushed out the open end 16.2 of the respective bottle cell 16, i.e. that force exerted by the respective treatment jet 26.1 on a bottle 2 being treated is less than or at most equal to the component of the weight force of this bottle 2 acting in the direction of the treatment jet.

In other words, as shown in FIG. 2, the treatment nozzles 26 are activated when the weight force of the bottle 2 is acting in a direction away from the open end 16.2 of the bottle cell 16, which occurs when the open end 16.2 is vertically higher than the closed end 16.1 of the bottle cell 16. This positioning causes the weight force of the bottle 2 to shift toward the closed end 16.1 of the bottle cell 16. This weight force works to counteract the force applied by the treatment liquid being sprayed by the respective treatment jet 26.1 into the bottle 2 to thus retain the bottle 2 inside the bottle cell 16.

The present application likewise teaches that the device for controlling the treatment nozzles 26 and the feed of the treatment medium to the treatment nozzles 26 is designed such that the treatment jets of a nozzle row 25, each of which jets is assigned to one row of bottle cells 16, can be controlled or adjusted independently of the other nozzle rows 25.

So doing makes it possible to adjust the strength of the treatment jets discharged through the nozzle row 25 during the rotation of the deflector 19 to match the magnitudinally changing force components of the weight force of the bottles 2, whereby the exchange of treatment medium can be improved even further.

In other words, as shown in FIG. 2 for example, as the bottles 2 are moved from a substantially horizontal position on their side to a substantially vertical position, the force exerted by the weight of the bottles 2 increases. Accordingly, the strength of the treatment jets 26.1 may also be increased since the increased weight force exerted by the bottles 2 will counteract the increased strength of the treatment jets 26.1 to thus retain the bottles 2 inside the bottle cells 16. By increasing the strength or force of the treatment jets 26.1, more treatment medium may be circulated through the interior of the bottles 2 at a faster rate and thus in a shorter amount of time. In addition, in at least one embodiment, the increased force of the treatment jets 26.1 would be more effective in removing contaminants from the interiors of the bottles 2.

In any case, each bottle 2 remains completely within the respective bottle cell 16 during the treatment or rinsing process, with its mouth 2.2 immediately or generally adjacent to and/or optimally aligned with the opening 17.

Impingement of the interior of the bottle with the treatment jet 26.1 results in an intensive exchange of the treatment liquid in the interior of the bottle with new treatment liquid from the dipping bath 8, which intensifies the efficacy of the treatment liquid in the bottle 2 being treated.

Treatment of the bottles 2 with the treatment jets 26.1 takes place using a free jet process, i.e. without the docking and/or insertion of treatment nozzles to and/or into the bottles 2. Instead the treatment nozzles 26 are at some distance from the side 16.1 of the bottle cells 16 and thus from the bottle mouths 2.1.

The pump 28 is of a variable design, so that the pumped volume and the pressure generated at both the pump discharge and at the treatment nozzles 26 can be controlled and/or set to adjust the treatment nozzle arrangement 23 for bottles 2 with a different mass and thus a different weight force.

By means of the controller 27, the treatment jets 26.1 can be controlled such that they are emitted from the treatment nozzles 26 either continuously or intermittently with at least one interruption over the entire path of motion of the deflector 19, in which path of motion the bottle is sufficiently turned and held in the respective bottle cell 16 with sufficient weight force counter to the effect of the treatment jets 26.1.

In at least one possible embodiment, the treatment jets 26.1 could be emitted in a pulsed manner intermittently or discontinuously. In such an embodiment, the pulses could be of such force that they could overcome the weight force produced by the bottles 2, but could be of such short duration that they would be insufficient to dislodge the bottles 2 from the bottle cells 16. Such an embodiment would permit a very forceful treatment of the interior of the bottles 2 to remove contaminants which are adhering firmly to the interior of the bottles 2 without dislodging the bottles 2.

The cross-section of the openings of the treatment nozzles 26 and thus the cross-section of the treatment jets 26.1 emitted by control action from these treatment nozzles is chosen such that the treatment jet 26.1 directed into a bottle 2 does not inhibit outflow of displaced or exchanged cleaning liquid, such as is shown in FIG. 3.

This exchange process can be enhanced by the appropriate configuration of the nozzle opening of the treatment nozzles, e.g. as ring nozzles.

Figure 5:
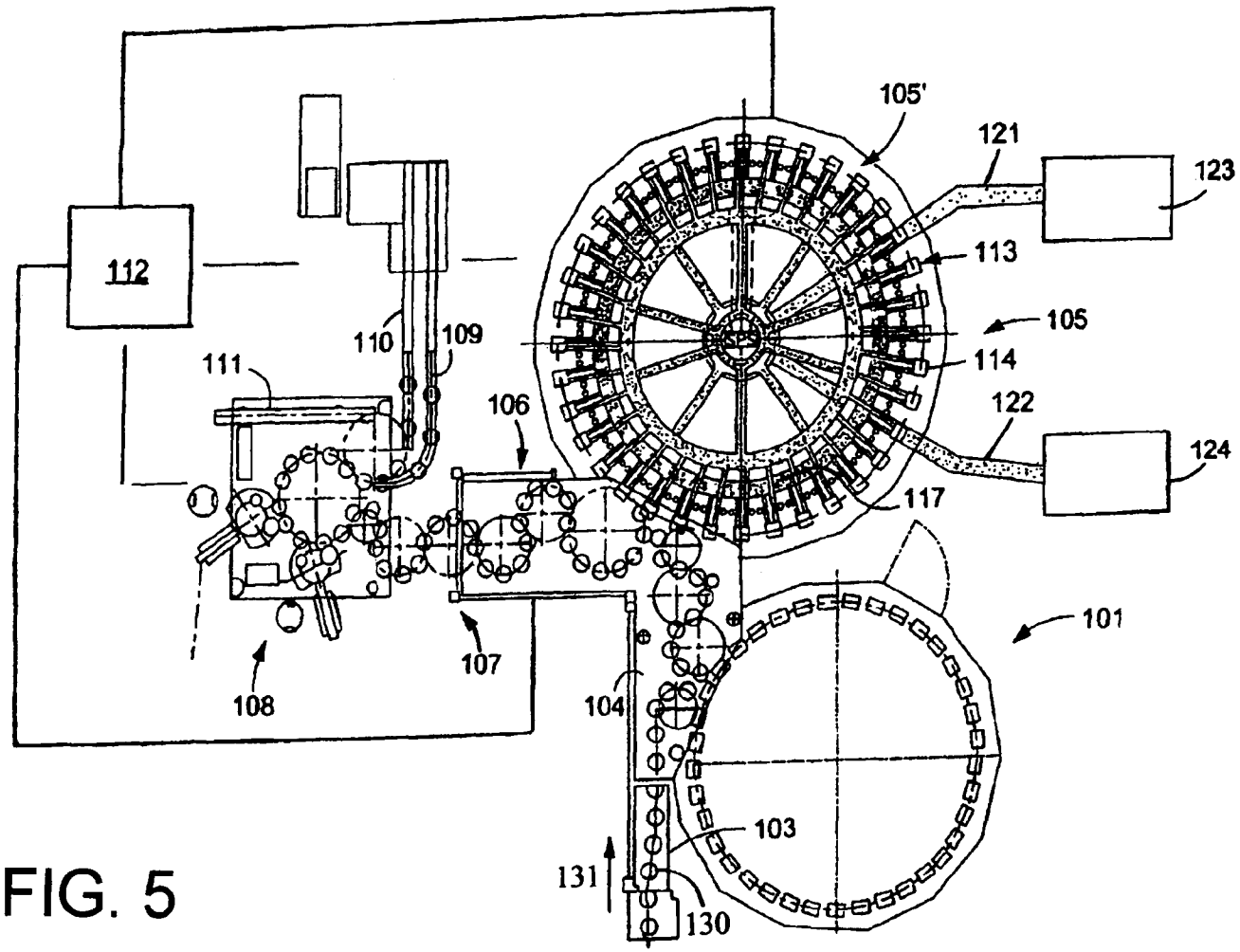
FIG. 5 shows schematically the main components of one possible embodiment example of a system for filling containers.

FIG. 5 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 5 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 5, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

In at least one embodiment, the cross section of the nozzle openings of the treatment nozzles could be adjustable to vary the volume of the treatment medium permitted to exit the nozzle openings. For example, the nozzle openings could be partially closed to restrict the volume of the flow of treatment medium, or could be fully opened to permit a maximum volume flow of treatment medium through the nozzle openings. In another example, each treatment nozzle could possibly be equipped with a movable or rotatable structure comprising two or more nozzle openings, which structure could be moved or rotated to move a nozzle opening of a first size out of an operational position and to move a nozzle opening of a second size into an operational position to change the volume of the flow of treatment medium therethrough. In at least one possible embodiment, the varying of the volume of treatment medium could permit each of the nozzles to operate at the same pressure throughout the movement of the bottles around the nozzle arrangement. To further explain, when the bottles are positioned substantially horizontally on their sides, the volume could be restricted to lessen the force produced by the stream of treatment medium. When the bottles are positioned substantially vertically, the volume could be increased to increase the force produced by the stream of treatment medium, even though the pressure would be the same as when the bottles were substantially horizontally on their sides. Such a design would permit the use of a single pressure source or pump rather than a variable pressure source or pump.

In another possible embodiment, the treatment nozzles will remain in a stationary position as the bottles are moved past, rather than move with the bottles. In such an embodiment, the group of treatment nozzles positioned to act on bottles that are disposed substantially horizontally would be configured to produce a jet of treatment medium having a reduced strength so as to not dislodge the bottles from the bottle cells. Other groups of treatment nozzles positioned to act on bottles that are disposed substantially vertically or at an angle would be configured to produce a jet of treatment medium having an increased strength since the weight force produced by the bottles would also be increased. Therefore, as the bottles would move past the stationary groups of treatment nozzles, the bottles would be acted on by jets of treatment medium of increasing strength corresponding to the increasing weight force. In such an embodiment, the treatment nozzles could either spray continuously as the bottles pass by, or the treatment nozzles could spray pulses intermittently at the approximate moment when the mouth openings of the bottles are temporarily aligned with the treatment nozzles.

As suggested by the broken line in FIG. 2, it is possible to heat the cleaning liquid drawn from the dipping bath 8 in a feed line leading to the pump 28 using a heater 30 and/or to use a metering device 31 to add an active substance (chemical) of the dipping bath 8 so that an exchange of the existing cleaning liquid with heated and/or "strengthened" or more efficacious treatment liquid occurs via the treatment jets 26.1.

Figure 4:
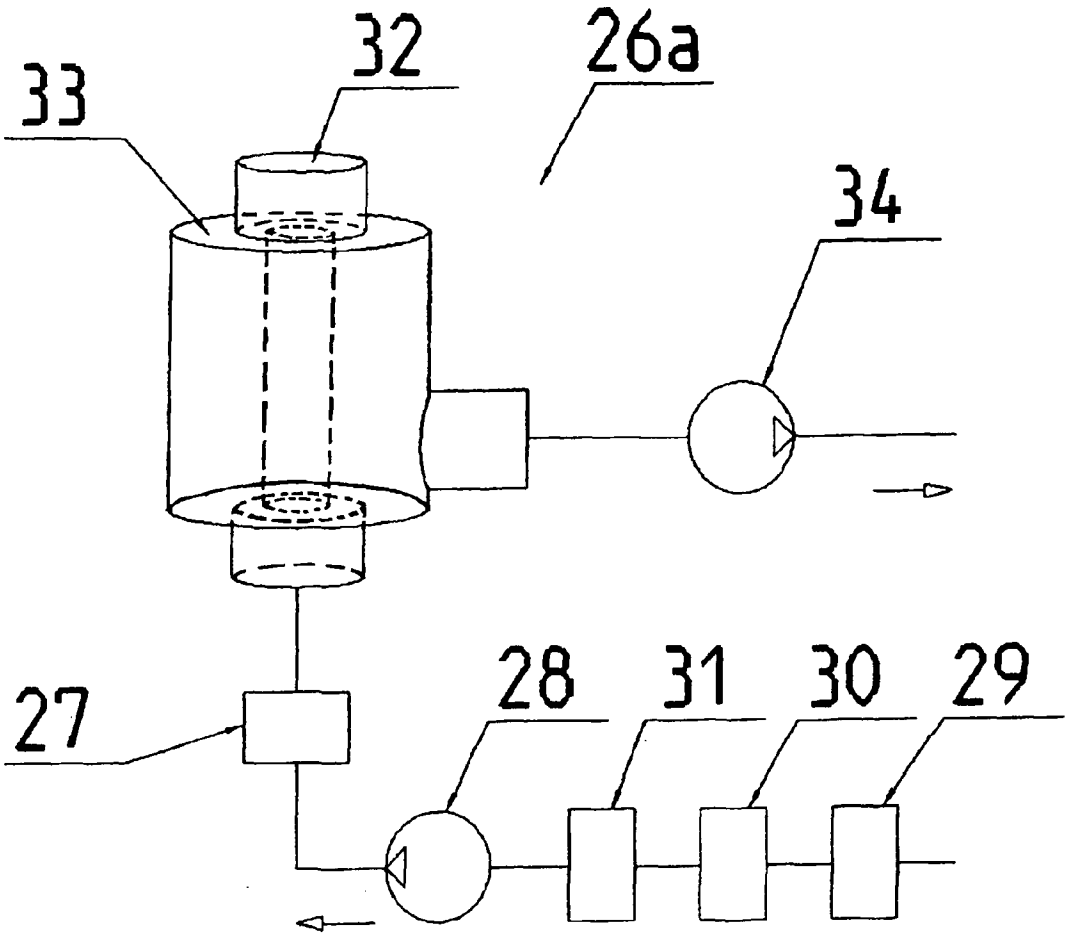
FIG. 4 shows a schematic of a single treatment nozzle configured as a ring nozzle together with additional functional elements.

FIG. 4 shows a treatment nozzle 26*a* configured as a ring nozzle that can be used instead of a treatment nozzle 26.

The treatment nozzle 26*a* has a central nozzle opening 32, which is used to form the respective treatment jet 26.1 and is connected to the discharge of the pump 28 via a controller 27.

In this embodiment, the intake of the pump is connected to the dipping bath 8 via the filter 29, the heater 30 and the metering device 31.

The treatment nozzle 26*a* also has a suction opening 33, which in the embodiment shown encircles the nozzle opening 32 and is connected to the intake of an additional pump 34, whose discharge is connected to the dipping bath 8.

By means of this configuration, the treatment liquid displaced/exchanged from inside a bottle 2 being treated by the treatment jet 26.1 is at least partly drawn off via the suction opening 33, significantly enhancing the exchange of cleaning liquid in the bottle 2 being treated.

In at least one possible embodiment, containers are cleaned in a container cleaning machine. In operation, the containers are fed into movable container receptacles in the container cleaning machine, and are then moved to a cleaning area. Upon arriving at the cleaning area, the containers are positioned for cleaning with their closed portions, such as the bottoms of the containers, at an equivalent or higher vertical position than their mouth portions, which could be the top or neck portions of the containers. In other words, the containers are positioned horizontally on their sides, vertically with the closed or bottom portions directly above the mouth or top portion, or in a tilted position between the horizontal or vertical positions in which the bottom portions are disposed at a higher position vertically than the top portions. In at least one embodiment, the containers could arrive at the cleaning area already in the desired or predetermined position for cleaning. Once appropriately positioned, the interiors of the containers are impinged with a jet of a cleaning medium from a nozzle arrangement which is positioned a distance from the containers. The jet has a spraying force which is either: insufficient to overcome the force of the weight of the containers and thus insufficient to push and move the containers from their resting position in their corresponding container receptacles; or sufficient to overcome the force of the weight of the containers and thus sufficient to push and move the containers from their resting position in their corresponding container receptacles, yet insufficient to move the containers to a position sufficient to interfere with the cleaning of the containers or the operation of the container cleaning machine. In other words, in one embodiment, the spraying force could be such that when the cleaning medium contacts the interiors of the containers, the containers do not move at all from their position in the container receptacles. In another embodiment, the spraying force could be such that when the cleaning medium contacts the interiors of the containers, the containers are moved from the position they were in prior to spraying to a new position. However, this new position is such that the containers do not interfere with the cleaning thereof for the operation of the cleaning machine. For example, if the spraying force were such that the containers would be completely or substantially dislodged from the receptacles, the dislodged containers would at the least be removed from the cleaning process, and at the worst could be damaged or could become jammed in a portion of the cleaning machine resulting in damage to the machine and/or stalling of the machine. On the other hand, the spraying force could be such that the containers would move some distance in the receptacles, but not so much that they would interfere with the cleaning process or the operation of the machine. In at least one embodiment, upon completion or termination of the spraying of the containers, the containers could slide or move back into the position they were in prior to spraying, such as the rest position. The appropriate, predetermined, or desired spraying force could be determined by experimentation to discover what amount of spraying force would be appropriate for bottles or containers of different sizes and weights. For example, a heavier glass bottle or container would be able to withstand a greater spraying force than would a lighter plastic bottle or container.

The above methods and embodiments could be utilized to clean or treat recycled bottles, reusable bottles, or return bottles.

The present application was described above with reference to one possible embodiment.

It will be understood that numerous modifications and derivations are possible without departing from the idea on which the present application is based.

It was assumed above that the treatment medium, in at least one possible embodiment, is a liquid medium. In at least one other possible embodiment, the treatment medium can also be a gaseous medium.

Mixtures of liquid and gaseous treatment media or the treatment with both media sequentially are also possible.

Method for the treatment of bottles or similar containers in a cleaning machine, in which the containers, arranged in receptacles of container carriers, are moved on a transport track formed in the treatment machine between a container inlet and a container outlet arranged in receptacles of container carriers, are moved on a transport track formed in the treatment machine between a container inlet and a container outlet through multiple treatment zones, of which at least one is a dipping bath with a liquid treatment medium.

One feature or aspect of an embodiment is believed at the time of the filing of this patent application to possibly reside broadly in a method for the treatment of bottles or similar containers 2 in a cleaning machine 1, in which the containers 2, arranged in receptacles 16 of container carriers 15, are moved on a transport track of a transport system 5 between a container inlet 6 and a container outlet 14 through multiple treatment zones, of which at least one is a dipping bath 8, whereby at a deflector 19 in the transport track inside the dipping bath 8, at which deflector 19 the path of the transport track causes the containers 2 to turn from an orientation with their container opening 2.1 facing up to an orientation with their container opening 2.1 facing down, the interior of each container 2 in the dipping bath 8 is impinged with a treatment jet 26.1 of a treatment medium from a treatment nozzle arrangement 2, wherein the respective treatment jet 26.1 is produced by a treatment nozzle arrangement 23 at some distance from the container 2 being treated and the container receptacle and is controlled such that those containers 2 whose force component of the weight force acting in the direction of the treatment jet 26.1 offsets the force imparted by the treatment jet at least to the extent that the container 2 being treated is not moved by the treatment jet 26.1 are impinged by the at least one treatment jet 26.1.

Another feature or aspect of an embodiment is believed at the time of the filing of this patent application to possibly reside broadly in the method, wherein the treatment jets 26.1 are controlled such that those containers 2 where the force component of their weight force opposite the treatment jet 26.1 is at least equal or roughly equal to the force imparted by the treatment jet 26.1 are impinged by the respective treatment jet 26.1.

Yet another feature or aspect of an embodiment is believed at the time of the filing of this patent application to possibly reside broadly in the method, wherein the pressure and/or volume of the treatment jets 26.1 are set as a function of the mass or the weight force of the containers 2.

Still another feature or aspect of an embodiment is believed at the time of the filing of this patent application to possibly reside broadly in the method, wherein the pressure and/or volume of the treatment jets 26.1 are changed at least once during the treatment.

A further feature or aspect of an embodiment is believed at the time of the filing of this patent application to possibly reside broadly in the method, wherein treatment jets 26.1 are interrupted at least once during the treatment of a container 2.

Another feature or aspect of an embodiment is believed at the time of the filing of this patent application to possibly reside broadly in the method, wherein the treatment medium for producing the treatment jets 26.1 is a liquid medium or a treatment liquid and/or a gaseous medium.

Yet another feature or aspect of an embodiment is believed at the time of the filing of this patent application to possibly reside broadly in the method, wherein the treatment medium for producing the treatment jets 26.1 is drawn from the dipping bath 8, e.g. via a feed line having at least one pump 28.

Still another feature or aspect of an embodiment is believed at the time of the filing of this patent application to possibly reside broadly in the method, wherein the treatment medium drawn from the dipping bath 8 is filtered.

A further feature or aspect of an embodiment is believed at the time of the filing of this patent application to possibly reside broadly in the method, wherein the pressure and/or flow rate of the pump 28 can be controlled and/or set to adjust for containers 2 having a different mass or a different weight force.

Another feature or aspect of an embodiment is believed at the time of the filing of this patent application to possibly reside broadly in the method, wherein the treatment medium is warmed or heated prior to being discharged from the treatment nozzle arrangement 23.

Yet another feature or aspect of an embodiment is believed at the time of the filing of this patent application to possibly reside broadly in the method, wherein an additive or active substance affecting the treatment is added to the treatment medium prior to the treatment medium being discharged from the treatment nozzle arrangement 23.

Still another feature or aspect of an embodiment is believed at the time of the filing of this patent application to possibly reside broadly in the method, wherein the treatment medium is replenished with the active substance of the dipping bath.

A further feature or aspect of an embodiment is believed at the time of the filing of this patent application to possibly reside broadly in the method, wherein the treatment jets 26.1 are shaped and directed at the respective container 2 such that the treatment liquid already in the container 2 being treated is displaced by the respective treatment jet 26.1.

One feature or aspect of an embodiment is believed at the time of the filing of this patent application to possibly reside broadly in the method, wherein the treatment nozzle arrangement 23 or the treatment nozzles 26, 26*a* comprising this arrangement are moved with the containers 2.

Another feature or aspect of an embodiment is believed at the time of the filing of this patent application to possibly reside broadly in the method, wherein the treatment fluid displaced from inside the treated container 2 by the respective treatment jet 26.1 is at least partly drawn off by at least one suction opening 33 adjacent to the container opening 2.1.

Yet another feature or aspect of an embodiment is believed at the time of the filing of this patent application to possibly reside broadly in the method, wherein the drawing off occurs via at least one suction opening 33 provided at each treatment nozzle 26, 26*a*.

Still another feature or aspect of an embodiment is believed at the time of the filing of this patent application to possibly reside broadly in the method, wherein the drawing off occurs via a suction opening 33 encircling the respective treatment nozzle 26*a*.

A further feature or aspect of an embodiment is believed at the time of the filing of this patent application to possibly reside broadly in the method, wherein the treatment jets 26.1 are directed radially or roughly radially outward at the containers being treated relative to at least one horizontal deflection axis of the deflector 19.

Another feature or aspect of an embodiment is believed at the time of the filing of this patent application to possibly reside broadly in the method, wherein treatment nozzles 26, 26*a* comprising the treatment nozzle arrangement 23 are moved along a path of motion at least partly enclosed by the transport track 5 in the area of the deflector 19.

Yet another feature or aspect of an embodiment is believed at the time of the filing of this patent application to possibly reside broadly in the method, wherein the container carriers 15 have perpendicular or substantially perpendicular to the direction of transport A of the transport system 5 at least two receptacles 16 for one container 2 each.

Still another feature or aspect of an embodiment is believed at the time of the filing of this patent application to possibly reside broadly in the method, wherein the container carriers are bottle baskets 15 and the receptacles are bottle cells 16.

A further feature or aspect of an embodiment is believed at the time of the filing of this patent application to possibly reside broadly in a cleaning machine for the cleaning of bottles or similar containers 2, having a transport system 5, with which the containers 2, arranged in receptacles 16 of container carriers 15, are moved on a transport track of the transport system 5 between a container inlet 6 and a container outlet 14 through multiple treatment zones, of which at least one is a dipping bath 8, with at least one deflector 19 formed by the transport track inside the dipping bath 8, at which deflector 19 the path of the transport track causes the containers 2 to turn from an orientation with their container opening 2.1 facing up to an orientation with their container opening 2.1 facing down, and with a treatment nozzle arrangement 23 for the impingement of the interior of each container 2 in the dipping bath 8 with a treatment jet 26.1 of a treatment medium, wherein the treatment nozzle arrangement 23 producing the treatment jets 26.1 is at some distance from the containers 2 and the container receptacles moving past, and that there is a controller for the control of the treatment nozzle arrangement 23 such that that those containers 2 whose force component of the weight force acting in the direction of the treatment jet 26.1 offsets the force imparted by the treatment jet at least to the extent that the container 2 being treated is not moved by the treatment jet 26.1 are impinged by the at least one treatment jet 26.1.

One feature or aspect of an embodiment is believed at the time of the filing of this patent application to possibly reside broadly in the cleaning machine, wherein the controller 27 for control of the treatment nozzle arrangement 23 is designed such that those containers 2 where the force component of their weight force opposite the treatment jet 26.1 is at least equal or roughly equal to the force imparted by the treatment jet 26.1 are impinged by the respective treatment jet 26.1.

Another feature or aspect of an embodiment is believed at the time of the filing of this patent application to possibly reside broadly in the cleaning machine, wherein the pressure and/or volume of the treatment jets 26.1 can be set as a function of the mass or the weight force of the containers 2.

Yet another feature or aspect of an embodiment is believed at the time of the filing of this patent application to possibly reside broadly in the cleaning machine, wherein the controller 27 for control of the treatment nozzle arrangement 23 is designed such that the pressure and/or volume of the treatment jets 26.1 is/are changed at least once during the treatment.

Still another feature or aspect of an embodiment is believed at the time of the filing of this patent application to possibly reside broadly in the cleaning machine, wherein the controller 27 for control of the treatment nozzle arrangement 23 is designed such that the treatment jets 26.1 are interrupted at least once during the treatment of a container 2.

A further feature or aspect of an embodiment is believed at the time of the filing of this patent application to possibly reside broadly in the cleaning machine, wherein the treatment medium for producing the treatment jets 26.1 is a liquid medium or a treatment liquid.

One feature or aspect of an embodiment is believed at the time of the filing of this patent application to possibly reside broadly in the cleaning machine, comprising a feed line for the treatment nozzle arrangement 23 having at least one pump 28.

Another feature or aspect of an embodiment is believed at the time of the filing of this patent application to possibly reside broadly in the cleaning machine, wherein the treatment medium for producing the treatment jets 26.1 is drawn from the dipping bath 8 via the feed line.

Yet another feature or aspect of an embodiment is believed at the time of the filing of this patent application to possibly reside broadly in the cleaning machine, comprising a filter 29 in the feed line.

Still another feature or aspect of an embodiment is believed at the time of the filing of this patent application to possibly reside broadly in the cleaning machine, comprising a heater 30 in the feed line.

A further feature or aspect of an embodiment is believed at the time of the filing of this patent application to possibly reside broadly in the cleaning machine, comprising a metering unit 31 in the feed line.

Another feature or aspect of an embodiment is believed at the time of the filing of this patent application to possibly reside broadly in the cleaning machine, wherein the pressure and/or flow rate of the pump 28 can be controlled and/or set to adjust for containers 2 having a different mass or a different weight force.

Yet another feature or aspect of an embodiment is believed at the time of the filing of this patent application to possibly reside broadly in the cleaning machine, wherein the treatment nozzle arrangement 23 or the treatment nozzles 26, **26*a* comprising this arrangement are moved with the containers 2**.

Still another feature or aspect of an embodiment is believed at the time of the filing of this patent application to possibly reside broadly in the cleaning machine, wherein the treatment nozzles **26*a* of the treatment nozzle arrangement 23** are configured as ring nozzles.

A further feature or aspect of an embodiment is believed at the time of the filing of this patent application to possibly reside broadly in the cleaning machine, wherein the treatment nozzles **26*a* have one nozzle opening 32 for a treatment jet 26.1 and one suction opening 33**.

One feature or aspect of an embodiment is believed at the time of the filing of this patent application to possibly reside broadly in the cleaning machine, wherein the treatment nozzles 26, **26*a* for the treatment jets 26.1 are directed radially or roughly radially outward at the containers being treated relative to at least one horizontal deflection axis of the deflector 19**.

Another feature or aspect of an embodiment is believed at the time of the filing of this patent application to possibly reside broadly in the cleaning machine, wherein treatment nozzles 26, **26*a* comprising the treatment nozzle arrangement 23 are moved along a path of motion at least partly enclosed by the transport track 5 in the area of the deflector 19**.

Yet another feature or aspect of an embodiment is believed at the time of the filing of this patent application to possibly reside broadly in the cleaning machine, wherein the container carriers 15 have perpendicular or substantially perpendicular to the direction of transport A of the transport system 5 at least two receptacles 16 for one container 2 each.

Still another feature or aspect of an embodiment is believed at the time of the filing of this patent application to possibly reside broadly in the cleaning machine, wherein the container carriers are bottle baskets 15 and the receptacles are bottle cells 16.

A further feature or aspect of an embodiment is believed at the time of the filing of this patent application to possibly reside broadly in a method for the treatment of bottles or similar containers 2 in a cleaning machine 1, in which the containers 2, arranged in receptacles 16 of container carriers 15, are moved on a transport track of a transport system 5 between a container inlet 6 and a container outlet 14 through multiple treatment zones, of which at least one is a dipping bath 8, whereby at a deflector 19 in the transport track inside the dipping bath 8, at which deflector 19 the path of the transport track causes the containers 2 to turn from an orientation with their container opening 2.1 facing up to an orientation with their container opening 2.1 facing down, the interior of each container 2 in the dipping bath 8 is impinged with a treatment jet 26.1 of a treatment medium from a treatment nozzle arrangement 23, wherein the respective treatment jet 26.1 is produced by a treatment nozzle arrangement 23 at some distance from the container 2 being treated and the container receptacle and is controlled such that those containers 2 whose force component of the weight force acting in the direction of the treatment jet 26.1 offsets the force imparted by the treatment jet at least to the extent that the container 2 being treated is not moved by the treatment jet 26.1 are impinged by the at least one treatment jet 26.1, whereby the pressure and/or volume of the treatment jets 26.1 are set as a function of the mass or the weight force of the containers 2.

One feature or aspect of an embodiment is believed at the time of the filing of this patent application to possibly reside broadly in a cleaning machine for the cleaning of bottles or similar containers 2, having a transport system 5, with which the containers 2, arranged in receptacles 16 of container carriers 15, are moved on a transport track of the transport system 5 between a container inlet 6 and a container outlet 14 through multiple treatment zones, of which at least one is a dipping bath 8, with at least one deflector 19 formed by the transport track inside the dipping bath 8, at which deflector 19 the path of the transport track causes the containers 2 to turn from an orientation with their container opening 2.1 facing up to an orientation with their container opening 2.1 facing down, and with a treatment nozzle arrangement 23 for the impingement of the interior of each container 2 in the dipping bath 8 with a treatment jet 26.1 of a treatment medium, wherein the treatment nozzle arrangement 23 producing the treatment jets 26.1 is at some distance from the containers 2 and the container receptacles moving past, and that there is a controller for the control of the treatment nozzle arrangement 23 such that those containers 2 whose force component of the weight force acting in the direction of the treatment jet 26.1 offsets the force imparted by the treatment jet at least to the extent that the container 2 being treated is not moved by the treatment jet 26.1 are impinged by the at least one treatment jet 26.1, whereby the pressure and/or volume of the treatment jets 26.1 can be set as a function of the mass or the weight force of the containers 2.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of adjustable nozzles and orifices and related components or systems that may possibly be utilized or adapted for use in at least one possible embodiment may possibly be found in the following U.S. Pat. No. 6,793,098, entitled "System and apparatus for foam dispensing with adjustable orifice flow regulating device and method of using same"; U.S. Pat. No. 5,160,119, entitled "Slide plate adjustable orifice"; U.S. Pat. No. 5,095,558, entitled "Adjustable orifice spa jet"; U.S. Pat. No. 5,094,272, entitled "Adjustable orifice plate seal"; U.S. Pat. No. 4,717,074, entitled "Adjustable orifice for a sprayer unit"; U.S. Pat. No. 4,479,593, entitled "Pump dispenser with adjustable nozzle"; and U.S. Pat. No. 4,141,503, entitled "Nozzle assembly with adjustable orifice."

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Jul. 29, 2008, and/or cited elsewhere are hereby incorporated by reference as if set forth in their entirety herein as follows: GB 1 209 323, having the title, "APPARATUS FOR WASHING LABELS OFF BOTTLES AND JARS," published Oct. 21, 1970; GB 168, 177, having the title "IMPROVEMENTS IN AND RELATING TO MACHINES FOR WASHING BOTTLES," published Sep. 15, 1921; GB 224 658, having the title "IMPROVEMENTS IN APPARATUS FOR WASHING BOTTLES," published on Nov. 20, 1924; and U.S. Pat. No. 899,017, having the title "BOTTLE SOAKING MACHINE," published on Sep. 22, 1908.

U.S. Pat. No. 7,392,632 issued Jul. 1, 2008, is incorporated by reference as if set forth in its entirety herein.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 039 599.9, filed on Aug. 23, 3006, having inventors Bernd MOLITOR and Klaus JENDRICHOWSKI, and DE-OS10 2006 039 599.9 and DE-PS10 2006 039 599.9, and International Application No. PCT/EP2007/007242, filed on Aug. 16, 2007, having WIPO Publication No. WO 2008/022740 and inventors Bernd MOLITOR and Klaus JENDRICHOWSKI, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/007242 and German Patent Application 10 2006 039 599.9 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/007242 and DE 10 2006 039 599.9 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Cleaning machine
2 Bottle
2.1 Bottle mouth
3 Housing of the cleaning machine
4 Interior of the cleaning machine j
5 Transport system
6 Bottle inlet or bottle input
7, 8 Dipping bath
9-13 Spray stations
14 Bottle discharge or bottle outlet
15 Bottle basket
16 Bottle cell
16.1 Closed end of the bottle cell 16
16.2 Open end of the bottle cell 16
17 Opening
18-22 Deflector
23 Treatment nozzle arrangement
24 Drum-like carrier
25 Row of nozzles
26, **26*a*** Treatment nozzle
26.1 Nozzle jet or treatment jet
27 Controller
28 Pump
29 Filter, e.g. fine filter
30 Heater
31 Metering unit for replenishing the treatment liquid
32 Nozzle opening

33 Suction opening
34 Pump
A Direction of transport
B Direction of rotation of the treatment nozzle arrangement 23
FA Bottle axis

What is claimed is:

1. A method of cleaning containers in a container cleaning machine, said method comprising the steps of:

inserting containers into container receptacles of a transport arrangement such that the containers are contained therein and are movable in said container receptacles along their longitudinal axes during cleaning;

moving said container receptacles, and containers contained therein, through a bath of liquid cleaning medium, which containers are in a first orientation in which mouth portions of the containers are at a higher vertical position than closed portions of the containers;

moving said container receptacles about a deflector in said bath of liquid cleaning medium to a second orientation in which the closed portions of the containers are at an equivalent vertical position or higher vertical position than the mouth portions of the containers; and operating a nozzle arrangement disposed a distance from the containers upon the containers being in said second orientation, and thereby impinging interiors of the containers with a cleaning medium with a force which is sufficiently high to maximize cleaning of the containers, and which is sufficiently low to essentially prevent movement of the containers along their longitudinal axes.

2. The method according to claim 1, wherein the force of said cleaning medium during cleaning is at most equal or approximately equal to an opposing weight force generated by each container being cleaned, which weight force is determined based on a weight of each container, an inclination of each container, and/or a fill level of said bath.

3. The method according to claim 2, wherein:

said nozzle arrangement is configured to produce at least one jet of said cleaning medium;

the cleaning medium for producing said at least one jet is a liquid medium or a cleaning liquid and/or a gaseous medium; and said method further comprises setting the pressure and/or volume of said at least one jet based on the opposing weight force of each container.

4. The method according to claim 3, wherein:

said nozzle arrangement comprises nozzles;

the cleaning medium for producing said at least one jet is drawn from said bath via a feed line having at least one pump;

said cleaning medium drawn from said bath is filtered;

the pressure and/or flow rate of said pump can be controlled and/or set to adjust for containers having a different mass or a different weight force;

said cleaning medium is warmed or heated prior to being discharged from said nozzle arrangement;

an additive or active substance affecting the cleaning is added to said cleaning medium prior to said cleaning medium being discharged from said nozzle arrangement;

said cleaning medium is replenished with said additive or active substance of said bath;

said at least one jet is shaped and directed at a corresponding container such that said liquid cleaning medium already in the container is displaced by said at least one jet;

said nozzle arrangement or said nozzles are moved with the containers;

said liquid cleaning medium displaced from inside the container by said at least one jet is at least partly drawn off by at least one suction opening adjacent to the container opening;

the drawing off occurs: via at least one suction opening provided at each nozzle, or via a suction opening encircling a corresponding nozzle;

said container receptacles are moved on a transport track between a container inlet and a container outlet;

said transport track causes the containers to turn from an orientation with their container opening facing up to an orientation with their container opening facing down at said deflector;

said at least one jet is directed radially or roughly radially outward at the container being treated relative to at least one horizontal deflection axis of said deflector;

nozzles of said nozzle arrangement are moved along a path of motion at least partly enclosed by said transport track in the area of said deflector;

the containers to be cleaned are return bottles or recycled bottles;

said transport arrangement comprises container carriers that each have, perpendicular to the direction of transport, at least two container receptacles; and said container carriers are bottle baskets and said receptacles are bottle cells.

5. The method according to claim 2, wherein said nozzle arrangement is configured to produce a plurality of jets, and said method further comprises changing the pressure and/or volume of said jets at least once during cleaning.

6. The method according to claim 5, wherein said method further comprises interrupting said jets at least once during cleaning.

7. The method according to claim 6, wherein:

the cleaning medium for producing said jets is drawn from said bath via a feed line having at least one pump;

said cleaning medium drawn from said bath is filtered;

the pressure and/or flow rate of said pump can be controlled and/or set to adjust for containers having a different mass or a different weight force;

said cleaning medium is warmed or heated prior to being discharged from said nozzle arrangement;

an additive or active substance affecting the cleaning is added to said cleaning medium prior to said cleaning medium being discharged from said nozzle arrangement;

said cleaning medium is replenished with said additive or active substance of said bath;

each jet is shaped and directed at a corresponding container such that said liquid cleaning medium already in the container is displaced by each jet;

said nozzle arrangement comprises nozzles, wherein said nozzle arrangement or said nozzles are moved with the containers;

said liquid cleaning medium displaced from inside the container by said jets is at least partly drawn off by at least one suction opening adjacent to the container opening;

the drawing off occurs: via at least one suction opening provided at each nozzle, or via a suction opening encircling a corresponding nozzle;

said container receptacles are moved on a transport track between a container inlet and a container outlet;

said transport track causes the containers to turn from an orientation with their container opening facing up to an orientation with their container opening facing down at said deflector;

said jets are directed radially or roughly radially outward at the containers being treated relative to at least one horizontal deflection axis of said deflector;

nozzles of said nozzle arrangement are moved along a path of motion at least partly enclosed by said transport track in the area of said deflector;

the containers to be cleaned are return bottles or recycled bottles;

said transport arrangement comprises container carriers that each have, perpendicular to the direction of transport, at least two container receptacles; and said container carriers are bottle baskets and said receptacles are bottle cells.

8. The method according to claim 2, wherein the force of said cleaning medium during cleaning is adjusted at least once based on at least one change in the opposing weight force of the containers caused by movement of the containers around said deflector.

9. The method according to claim 8, wherein the opposing weight force of the containers increases as the angle of the longitudinal axis of the containers with respect to the horizontal increases, and thus the force of said cleaning medium is increased in a corresponding manner.

10. The method according to claim 9, wherein:

said nozzle arrangement comprises nozzles, wherein said nozzle arrangement or said nozzles are moved with the containers;

said nozzle arrangement is configured to produce at least one jet of said cleaning medium; and said at least one jet is directed radially or roughly radially outward at the containers being treated relative to at least one horizontal deflection axis of said deflector.

11. An arrangement for cleaning containers in a container cleaning machine, said arrangement comprising:

a transport arrangement comprising container receptacles configured to receive containers therein such that the containers are contained therein and are movable in said container receptacles along their longitudinal axes during cleaning;

a deflector arrangement in a bath of liquid cleaning medium;

said transport arrangement being configured to move said container receptacles and containers contained therein through said bath of liquid cleaning medium with the containers in a first orientation in which mouth portions of the containers are at a higher vertical position than closed portions of the containers, and then move said container receptacles about said deflector to a second orientation in which the closed portions of the containers are at an equivalent vertical position or higher vertical position than the mouth portions of the containers; and a nozzle arrangement being disposed a distance from the positioned containers, and being configured to be operated to thereby impinge interiors of the containers with a cleaning medium with a force which is sufficiently high to maximize cleaning of the containers, and which is sufficiently low to essentially prevent movement of the containers along their longitudinal axes.

12. The arrangement according to claim 11, wherein said arrangement further comprises a controller configured to control the force of said cleaning medium such that the force of said cleaning medium during cleaning is at most equal or approximately equal to an opposing weight force generated by each container being cleaned, which weight force is determined based on a weight of each container, an inclination of each container, and/or a fill level of said bath.

13. The arrangement according to claim 12, wherein:

said nozzle arrangement is configured to produce at least one jet of said cleaning medium;

the cleaning medium for producing said at least one jet is a liquid medium or a cleaning liquid and/or a gaseous medium; and said controller is configured to set the pressure and/or volume of said at least one jet based on the opposing weight force of each container.

14. The arrangement according to claim 13, wherein:

said nozzle arrangement comprises nozzles;

the cleaning medium for producing said at least one jet is drawn from the bath via a feed line having at least one pump;

the cleaning medium drawn from the bath is filtered;

the pressure and/or flow rate of said pump can be controlled and/or set to adjust for containers having a different mass or a different weight force;

said cleaning medium is warmed or heated prior to being discharged from said nozzle arrangement;

an additive or active substance affecting the cleaning is added to said cleaning medium prior to said cleaning medium being discharged from said nozzle arrangement;

said cleaning medium is replenished with said additive or active substance of said bath;

said at least one jet is shaped and directed at a corresponding container such that said liquid cleaning medium already in the container is displaced by said at least one jet;

said nozzle arrangement or said nozzles are moved with the containers;

said liquid cleaning medium displaced from inside the container by said at least one jet is at least partly drawn off by at least one suction opening adjacent to the container opening;

the drawing off occurs: via at least one suction opening provided at each nozzle, or via a suction opening encircling a corresponding nozzle;

said container receptacles are moved on a transport track between a container inlet and a container outlet;

said transport track comprises a deflector, at which deflector the path of said transport track causes the containers to turn from an orientation with their container opening facing up to an orientation with their container opening facing down;

said at least one jet is directed radially or roughly radially outward at the container being treated relative to at least one horizontal deflection axis of said deflector;

nozzles of said nozzle arrangement are moved along a path of motion at least partly enclosed by said transport track in the area of said deflector;

the containers to be cleaned are return bottles or recycled bottles;

said transport arrangement comprises container carriers that each have, perpendicular to the direction of transport, at least two container receptacles; and said container carriers are bottle baskets and said receptacles are bottle cells.

15. The arrangement according to claim 12, wherein said nozzle arrangement is configured to produce a plurality of jets, and said controller is configured to change the pressure and/or volume of said jets at least once during cleaning.

16. The arrangement according to claim 15, wherein said controller is configured to interrupt said jets at least once during cleaning of a container.

17. The arrangement according to claim 16, wherein:

the cleaning medium for producing said jets is drawn from the bath via a feed line having at least one pump;

the cleaning medium drawn from the bath is filtered;

the pressure and/or flow rate of said pump can be controlled and/or set to adjust for containers having a different mass or a different weight force;

said cleaning medium is warmed or heated prior to being discharged from said nozzle arrangement;

an additive or active substance affecting the cleaning is added to said cleaning medium prior to said cleaning medium being discharged from said nozzle arrangement;

said cleaning medium is replenished with said additive or active substance of said bath;

each jet is shaped and directed at a corresponding container such that said liquid cleaning medium already in the container is displaced by said jet;

said nozzle arrangement comprises nozzles, wherein said nozzle arrangement or said nozzles are moved with the containers;

said liquid cleaning medium displaced from inside the container by said jet is at least partly drawn off by at least one suction opening adjacent to the container opening;

the drawing off occurs: via at least one suction opening provided at each nozzle, or via a suction opening encircling a corresponding nozzle;

said container receptacles are moved on a transport track between a container inlet and a container outlet;

said transport track causes the containers to turn from an orientation with their container opening facing up to an orientation with their container opening facing down at said deflector;

said jets are directed radially or roughly radially outward at the containers being treated relative to at least one horizontal deflection axis of said deflector;

nozzles of said nozzle arrangement are moved along a path of motion at least partly enclosed by said transport track in the area of said deflector;

the containers to be cleaned are return bottles or recycled bottles;

said transport arrangement comprises container carriers that each have, perpendicular to the direction of transport, at least two container receptacles; and said container carriers are bottle baskets and said receptacles are bottle cells.

18. The arrangement according to claim 12, wherein said controller is configured to adjust the force of said cleaning medium during cleaning at least once based on at least one change in the opposing weight force of the containers caused by movement of the containers around said deflector.

19. The arrangement according to claim 18, wherein the opposing weight force of the containers increases as the angle of the longitudinal axis of the containers with respect to the horizontal increases, and said controller is configured to increase the force of said cleaning medium in a corresponding manner.

20. The arrangement according to claim 19, wherein:

said nozzle arrangement is configured to produce at least one jet of said cleaning medium; and said at least one jet is directed radially or roughly radially outward at the containers being treated relative to at least one horizontal deflection axis of said deflector.

* * * * *